US006253381B1

(12) United States Patent
Kelley

(10) Patent No.: US 6,253,381 B1
(45) Date of Patent: Jul. 3, 2001

(54) WEARING APPAREL WITH MITTENS OR GLOVES IN THE SLEEVES

(76) Inventor: Thomas Jeffrey Kelley, 11650 Tierra Del Sur, San Diego, CA (US) 92130

( * ) Notice: Subject to any disclaimer, the term of this patent is extended or adjusted under 35 U.S.C. 154(b) by 0 days.

(21) Appl. No.: 09/632,034

(22) Filed: Aug. 3, 2000

Related U.S. Application Data

(60) Provisional application No. 60/180,034, filed on Feb. 3, 2000.

(51) Int. Cl.[7] ..... A41D 27/10
(52) U.S. Cl. ..... 2/125; 2/158
(58) Field of Search ..... 2/69, 268, 270, 2/158, 159, 115, 247, 59, 125, 108, 90, 16

(56) References Cited

U.S. PATENT DOCUMENTS 1,183,792 * 5/1916 Aron ..... 2/270
2,136,879 * 11/1938 Haber et al. ..... 2/270
2,274,510 * 2/1942 Wohl et al. ..... 2/270
3,214,771 * 11/1965 Treiber ..... 2/270
4,359,784 * 11/1982 Harrington ..... 2/269
4,980,929 * 1/1991 Long ..... 2/125
5,784,720 * 7/1998 Mellon et al. ..... 2/125
5,794,265 * 8/1998 Reich ..... 2/125
5,815,837 * 10/1998 Chrisman et al. ..... 2/158
5,953,758 * 9/1999 Foster ..... 2/268

* cited by examiner

*Primary Examiner*—Gloria M. Hale
*Assistant Examiner*—Tejash Patel
(74) *Attorney, Agent, or Firm*—Thomas R. Juettner; Greer, Burns & Crain, Ltd.

(57) ABSTRACT

Long-sleeved wearing apparel are provided with self-contained mittens or gloves, each comprising an open-top hand and finger pocket secured in the interior of the sleeve adjacent to the lower end of the sleeve, an opening in the sleeve adjacent to the upper end of the hand and finger pocket, and a thumb pocket secured to the sleeve at the opening and extendable and retractable through the opening to form with the hand and finger pocket a self-contained mitten or glove.

20 Claims, 2 Drawing Sheets

FIG. 3
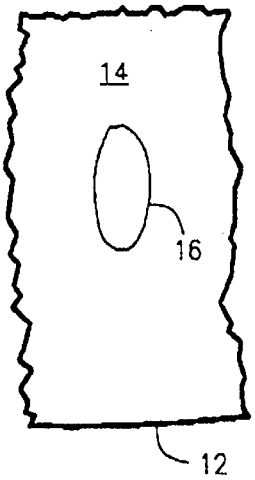
FIG. 2
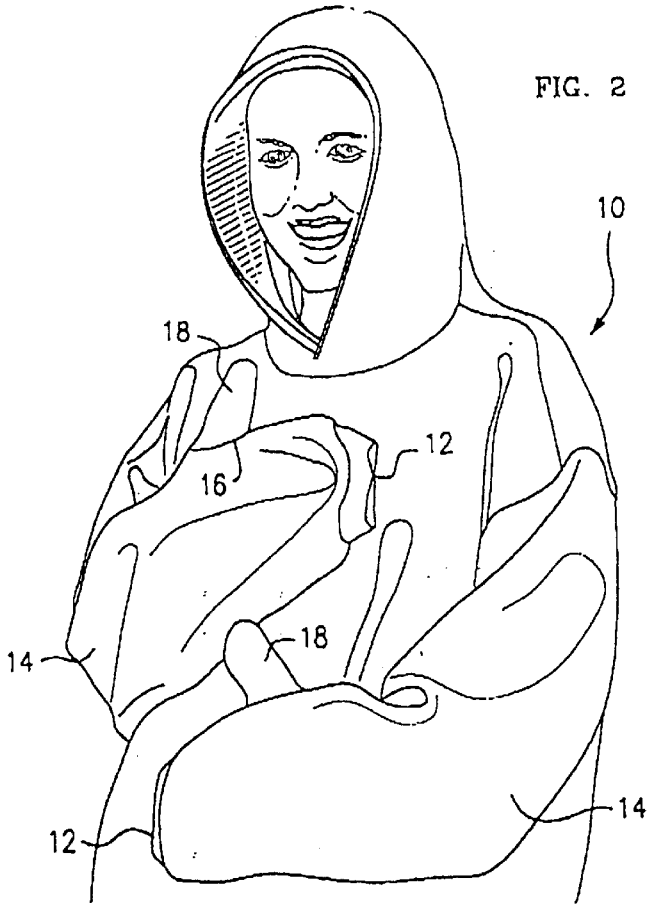
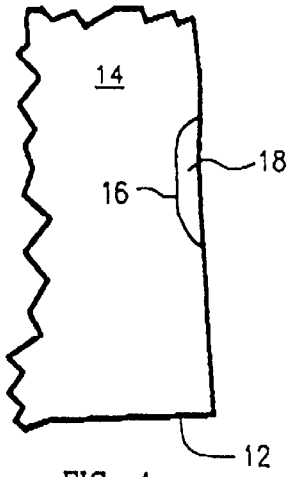
FIG. 4
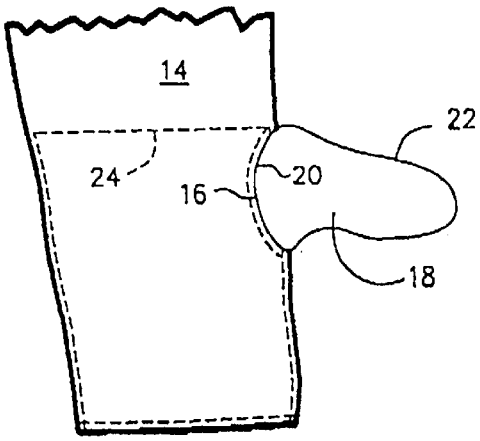
FIG. 5
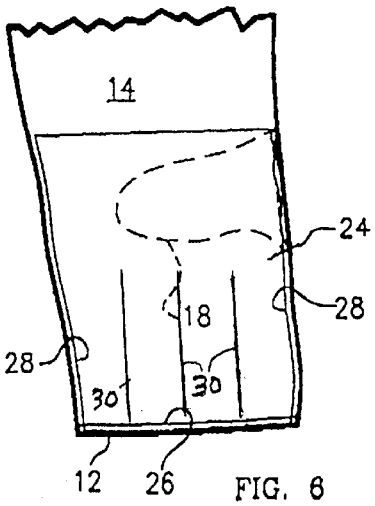
FIG. 6

WEARING APPAREL WITH MITTENS OR GLOVES IN THE SLEEVES

CROSS REFERENCE

This application claims the priority of copending provisional application No. 60/180,034, filed Feb. 3, 2000.

FIELD OF THE INVENTION

The present invention relates to long-sleeved wearing apparel and to the incorporation of self-contained mittens or gloves within the sleeves of such garments.

BACKGROUND

In cool, cold and inclement weather, it is customary for humans to wear a sweater, sweatshirt, jacket, coat or like long-sleeved garment to ward off the cold and to protect themselves from rain and snow. In most instances, it is also desirable to wear mittens or gloves. However, people do not always remember to take their mittens or gloves with them and/or the same are frequently lost or misplaced.

Mothers have, for years, tied their children's mittens to a long string that is passed through the sleeves and across the shoulders of the jacket or snowsuit to retain the mittens associated with the jacket, but this is cumbersome and rarely totally successful. Skiers sometimes use small versions of suspender straps to clip their ski gloves to their jackets, but the gloves dangle cumbersomely from the jacket and are frequently lost when they are not being worn.

A better solution is needed.

SUMMARY OF THE INVENTION

The object of the invention is to provide long-sleeved wearing apparel with self-contained and permanently associated mittens or gloves.

Another object of the invention is to provide long-sleeved wearing apparel with self-contained mittens or gloves that include a thumb receiving part or pocket extendable from the sleeve and enabling the wearer to grasp articles between her/his hand or fingers and thumb in the same manner as with a conventional mitten or glove.

It is in particular an object of the invention to provide long-sleeved wearing apparel with mittens or gloves self-contained within the sleeves and each comprised of an open-top pocket or plurality of pockets for the fingers and the hand of the wearer on the interior surface of the sleeve, adjacent the lower end or cuff of the sleeve, and an extendible and retractable thumb pocket adjacent the upper end of the finger/hand pocket or pockets and secured to the marginal edges of a hole in the sleeve for extension outwardly from the sleeve when the mitten or glove is in use, and for retraction into the interior of the sleeve when the mitten or glove is not in use.

The mittens or gloves are therefore fully functional and self-contained in and permanently associated with the wearing apparel sleeves and cannot be lost, stolen, misplaced or forgotten.

These and other objects and advantages of the invention will become apparent from the following detailed description as considered in conjunction with the accompanying drawings.

BRIEF DESCRIPTION OF THE DRAWINGS

FIG. 2 is an illustration of a mannequin wearing the same garment and showing the garment with the self-contained mittens in use and with the thumb pockets extended;

FIG. 3 is a plan view of a portion of a garment sleeve containing an extendable and retractable thumb pocket;

FIG. 4 is a side elevation of the same portion of the sleeve showing the appearance thereof when the thumb pocket is retracted;

FIG. 5 is a side elevation of the same portion of the sleeve showing the thumb pocket extended and indicating in dotted lines the position of the finger and hand pocket on the interior of the sleeve; and FIG. 6 is a plan view of the interior of the sleeve showing the finger pocket and indicating in dotted lines the location of the thumb pocket when in the retracted position.

DETAILED DESCRIPTION OF A PREFERRED EMBODIMENT

Figure 1:
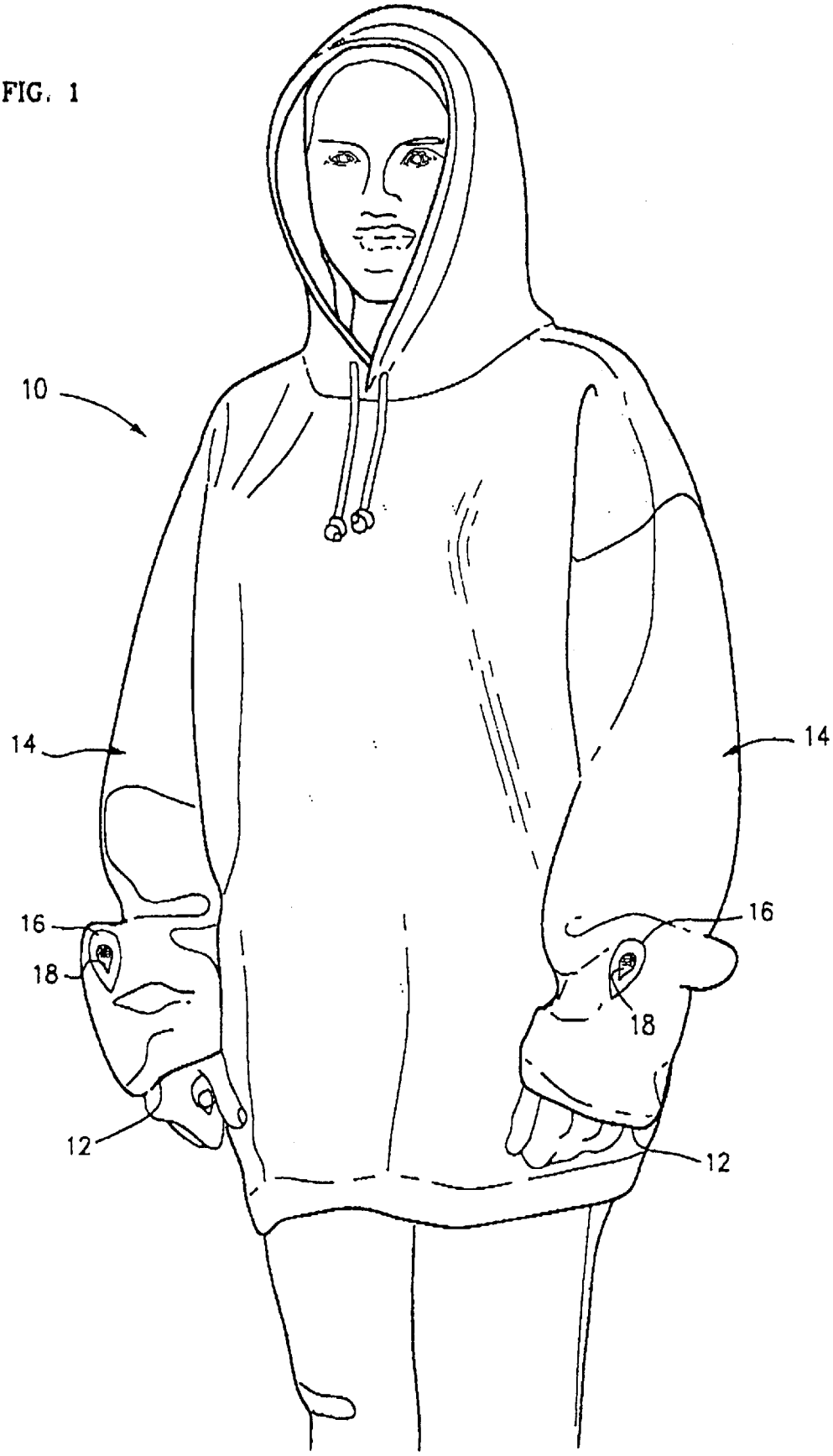
FIG. 1 is an illustration of a mannequin wearing a sweater or like garment embodying the mittens or gloves of the invention and showing the garment with the self-contained mittens not in use.

Following is a description of one embodiment of the present invention presently deemed by the inventor to be the best mode of carrying out the invention.

As shown by the illustration in FIG. 1, a long-sleeved garment 10 embodying the self-contained mittens of the invention, has an entirely conventional appearance when the mittens are not in use. The wearer's hands extend freely from the lower ends or the cuffs 12 of the sleeves 14 in the customary manner. The only exception is the appearance of a generally elliptical opening 16 in each of the sleeves 14 which, depending upon the materials and/or colors of both the garment and the thumb pockets, may be visibly perceptible or almost imperceptible.

Each elliptical opening 16 contains an extendable thumb pocket 18 which is extended from the sleeve when the self-contained mittens are in use. As shown in the FIG. 2 illustration, with the mittens in use, the wearer's thumbs are encased in the thumb pockets 18, and the wearer's hands are encased within finger and hand pockets provided within the interior of the sleeves 14.

The mittens are permanently associated with the garment and cannot, independently of the garment, be lost, stolen, misplaced or forgotten. The thumb pockets 18 can be of the same material and the same color as the garment sleeves or, to make a fashion statement, can be of a different material and/or color. As a general rule, the materials of both the garment and the thumb pockets, whether the same or different, should be body heat retaining materials.

Referring now to FIGS. 3–6, the details of construction of the presently preferred embodiment of the self-contained mittens of the invention are described as follows:

As shown in FIG. 3, a generally elliptical opening 16 is formed in each sleeve 14 of the garment about a hand's length above the lower end or cuff 12 of the sleeve. The marginal base edge 20 of a thumb pocket 18 is securely fastened, as shown in FIG. 5, to the marginal edge of the opening 16, for example, by stitching or other fastening systems employed from time to time by those reasonably skilled in the art. The thumb pocket may be made in any manner customary in the art, such for example, as folding a piece of fabric or other material upon itself, trimming the side and end edges 22 to desired shape, and securely fastening said edges 22 one to the other. Alternatively, two pieces of material of the desired shape and size may be secured together at their side and end margins.

The fabric or material from which the pocket 18 is formed is selected to be sufficiently flexible or pliable so that the pocket can be reversely folded inwardly on itself and pushed from the extended position of FIG. 5 to the retracted position of FIG. 4, or more specifically, the retracted position illustrated by dotted lines in FIG. 6.

As shown in FIG. 6, the sleeve 14 is provided on its interior surface with a finger and hand pocket 24 that has a width equal approximately to the width of the sleeve, and a length or height equal approximately to the length of the wearer's fingers and hand. The bottom 26 of the pocket 24 is located adjacent the end or cuff 12 of the sleeve, and the bottom 26 and side edges 28 of the pocket are securely fastened to the sleeve, thereby to define an open-top pocket for reception of the wearer's hand and fingers. The open-top pocket 24 may be comprised of a single ply to receive the hand between the sleeve and the pocket ply, or of two plies to receive the hand between the two plies of the pocket material. The latter construction provides a particularly warm and comfortable mitten.

If a person prefers a glove to a mitten, three stitches 30 of finger length maybe made in the bottom portion of the pocket 24. In this event, a stretchy or elastic material may be preferred for the pocket 24.

The two pockets 18 and 24 are so formed in the sleeve that the thumb pocket 18, when in its retracted position, will be housed within the hand and finger pocket 24, as is depicted schematically by the dotted line representation in FIG. 6. Consequently, when retracted, the thumb pocket does not interfere with a comfortable fit of the sleeve on the wearer's arm.

The two pockets 18 and 24 may be located wherever desired in the sleeve, but conventional design would call for the hand pocket to be either on the top side or the bottom side of the sleeve and with the thumb pocket at approximately a right angle to the upper edge portion of the hand pocket. The preferred location for the hand pocket is on the top side of the sleeve so that the fingers can close the end of the sleeve and mitigate entry of cold air into the sleeve; or the end of the sleeve can be closed with fabric loop and hook closures.

The mittens or gloves are easily and simply incorporated into long-sleeved garments, such as sweaters, sweatshirts, pullovers, wind breakers, jackets, coats, etc., either during manufacture of the garments or as an afterthought. When incorporated, they are essentially invisible when not in use; they do not detract from the appearance of the garment or interfere with the garment's fit; yet, they are always accessible and ready for use; they offer complete functional use of the fingers, hand and thumb; and they cannot be lost, stolen, misplaced or forgotten independently of the garment.

The objects and advantages of the invention have therefore been shown to be attained in a convenient, practical and facile manner.

While one preferred embodiment of the invention has been herein illustrated and described, it is to be understood that various changes, rearrangements and modifications may be made therein without departing from the scope of the invention as defined by the appended claims.

What is claimed is:

1. In long-sleeved wearing apparel, the improvement comprising an open-top hand and finger pocket within the interior of the sleeve, adjacent to a lower end of the sleeve;

an opening in the sleeve adjacent to a upper end of the hand and finger pocket; and a thumb pocket secured to the sleeve at said opening and extendible and retractable through said opening;

said pockets comprising a mitten or glove which, whether in use or not in use, is self-contained within the sleeve.

2. In long-sleeved wearing apparel as set forth in claim 1, said hand and finger pocket comprising a piece of material secured at its lower and side edges to the interior of the sleeve and defining with the interior of the sleeve said hand and finger pocket.

3. In long-sleeved wearing apparel as set forth in claim 1, said hand and finger pocket comprising two plies of material defining an open-top pocket secured to the interior of the sleeve.

4. In long-sleeved wearing apparel as set forth in claim 1, said hand and finger pocket having means in the lower end portion thereof dividing said portion into individual finger pockets.

5. In long-sleeved wearing apparel as set forth in claim 1, said hand and finger pocket being located on the interior of the top side of the sleeve.

6. In long-sleeved wearing apparel as set forth in claim 1, said hand and finger pocket being located on the interior of the bottom side of the sleeve.

7. In long-sleeved wearing apparel as set forth in claim 1, the thumb pocket comprising a material different from that of the sleeve.

8. In long-sleeved wearing apparel as set forth in claim 1, said hand and finger pocket being of a length equal approximately to the length of the fingers and hand of a wearer, said thumb pocket being located below the upper end of said hand and finger pocket and when retracted being stored within the interior of said hand and finger pocket.

9. Wearing apparel having long sleeves and including in each sleeve means within the interior of the sleeve adjacent a lower end thereof defining an open-top pocket for reception of the wearer's hand and fingers;

an opening in the sleeve adjacent a upper end of said open-top pocket and communicating with the interior of said pocket;

a thumb pocket in said opening communicating with the interior of said open-top pocket and being extendible from and retractable into said open-top pocket;

said open-top and thumb pockets comprising a mitten or glove self-contained within the sleeve.

10. Wearing apparel as set forth in claim 9, said open-top pocket comprising a piece of material secured at its lower and side edges to the interior of the sleeve and defining with the interior of the sleeve said open-top pocket.

11. Wearing apparel as set forth in claim 9, said open-top pocket comprising two pieces of material defining an open-top pocket secured to the interior of the sleeve.

12. Wearing apparel as set forth in claim 9, said open-top pocket having means in the lower end portion thereof dividing said portion into individual finger pockets.

13. Wearing apparel as set forth in claim 9, said hand and finger pocket being located on the interior of the top side of the sleeve.

14. Wearing apparel as set forth in claim 9, said hand and finger pocket being located on the interior of the bottom side of the sleeve.

15. Wearing apparel as set forth in claim 9, the thumb pocket comprising a material different from that of the sleeve.

16. Wearing apparel as set forth in claim 9, said open-top pocket being of a length equal approximately to the length of the fingers and hand of a wearer, said thumb pocket being located below the upper end of said open-top pocket and when retracted being stored within the interior of said open-top pocket.

17. Wearing apparel having long sleeves and including in each sleeve means within the interior of the sleeve adjacent a lower end thereof defining an open-top pocket for reception of the wearer's hand and fingers and being of a length equal approximately to the length of the wearer's hand and fingers;

an opening in the sleeve adjacent but below a upper end of said open-top pocket and communicating with the interior of said pocket;

a thumb pocket in said opening communicating with the interior of said open top pocket and being extendible from and retractable into said open-top pocket, and when retracted being stored within the interior of said open-top pocket;

said open-top and thumb pockets comprising a mitten or glove self-contained within the sleeve.

18. Wearing apparel as set forth in claim 17, said open-top pocket comprising a piece of material secured at its lower and side edges to the interior of the sleeve and defining with the interior of the sleeve said open-top pocket.

19. Wearing apparel as set forth in claim 17, said open-top pocket being located on the interior of the top side of the sleeve.

20. Wearing apparel as set forth in claim 17, the thumb pocket comprising a material different from that of the sleeve.

* * * * *